US009105413B2

(12) United States Patent
Hiranuma et al.

(10) Patent No.: US 9,105,413 B2
(45) Date of Patent: Aug. 11, 2015

(54) PORTABLE APPARATUS AND PORTABLE TIMEPIECE

(71) Applicant: Seiko Instruments Inc., Chiba (JP)

(72) Inventors: Haruki Hiranuma, Chiba (JP); Koremoto Takeda, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 88 days.

(21) Appl. No.: 13/738,054

(22) Filed: Jan. 10, 2013

(65) Prior Publication Data

US 2013/0215724 A1 Aug. 22, 2013

(30) Foreign Application Priority Data

Feb. 7, 2012 (JP) ..... 2012-024256

(51) Int. Cl.

| | |
|---|---|
| ***G04B 29/00*** | (2006.01) |
| ***G04B 37/00*** | (2006.01) |
| ***H01H 1/06*** | (2006.01) |
| ***H01H 3/12*** | (2006.01) |
| ***H01H 13/14*** | (2006.01) |
| ***H01H 13/70*** | (2006.01) |
| ***H01H 9/20*** | (2006.01) |
| ***G04B 3/00*** | (2006.01) |
| ***G04B 3/04*** | (2006.01) |
| ***G04C 3/00*** | (2006.01) |
| ***H01H 13/06*** | (2006.01) |
| *G04B 37/10* | (2006.01) |
| *H01H 13/52* | (2006.01) |

(52) U.S. Cl.

CPC ..... *H01H 9/20* (2013.01); *G04B 3/001* (2013.01); *G04B 3/043* (2013.01); *G04B 3/046* (2013.01); *G04C 3/001* (2013.01); *H01H 3/12* (2013.01); *H01H 13/06* (2013.01); *G04B 37/106* (2013.01); *H01H 13/52* (2013.01); *H01H 2225/016* (2013.01)

(58) Field of Classification Search

CPC ..... G04B 3/001; G04B 3/043; G04B 3/046; G04B 3/048

USPC ..... 368/288–290, 308, 319, 320, 306, 321; 200/276, 276.1, 341, 345, 520

See application file for complete search history.

(56) References Cited

U.S. PATENT DOCUMENTS

| | | | | |
|---|---|---|---|---|
| 3,362,154 | A * | 1/1968 | Perret | 368/290 |
| 7,192,182 | B2 * | 3/2007 | Hiranuma et al. | 368/289 |
| 8,653,390 | B2 * | 2/2014 | Shim et al. | 200/341 |
| 2003/0147312 | A1 * | 8/2003 | Hiranuma et al. | 368/319 |

(Continued)

FOREIGN PATENT DOCUMENTS

| | | |
|---|---|---|
| JP | 2003 007164 | 1/2003 |

*Primary Examiner* — Amy Cohen Johnson
*Assistant Examiner* — Daniel Wicklund
(74) *Attorney, Agent, or Firm* — Adams & Wilks

(57) ABSTRACT

A pushbutton of a portable apparatus is locked against inward axial movement by engagement with a locking member when the locking member is unthreaded a distance A from the apparatus body and brought into abutment with a fixed stopper member. The pushbutton is released from its locked state when the locking member is threaded into the apparatus body and brought out of abutment with the stopper member and into abutment with the apparatus body. In its unlocked state, a head portion of the pushbutton is axially spaced a distance B from an opposedly facing portion of the locking member, wherein A≤B.

16 Claims, 7 Drawing Sheets

(56) References Cited

U.S. PATENT DOCUMENTS

2004/0256205 A1* 12/2004 Oshio et al. ..... 200/43.13
2007/0074545 A1* 4/2007 Hiranuma et al. ..... 70/25
2009/0135682 A1* 5/2009 Hiranuma et al. ..... 368/289
2011/0036698 A1* 2/2011 Wahrenberg ..... 200/345
2012/0103774 A1* 5/2012 Jun ..... 200/345

* cited by examiner

PORTABLE APPARATUS AND PORTABLE TIMEPIECE

BACKGROUND OF THE INVENTION

1. Field of the Invention

The present invention relates to a portable apparatus and a portable timepiece provided with a push button.

2. Description of the Related Art

Among portable timepieces such as a wrist watch or a pocket watch or portable apparatuses such as a stop watch, a mobile phone or a personal digital assistant, there has been known a portable timepiece or a portable apparatus where a push button which operates a contact or the like in the inside of an apparatus exterior body is mounted on the apparatus exterior body. By pushing the push button with a predetermined stroke, for example, in the portable timepiece, a dial can be illuminated, or a time display can be changed from an analogue display to a digital display or from a digital display to an analogue display, or date and day which are digitally displayed can be corrected.

This type of portable apparatus is configured such that the push button is biased in the direction opposite to the pushing direction of the push button by a spring and hence, the removal of the push button from a pipe to the outside is prevented by a force of the spring. As such a removal preventive constitution, on an end portion of the push button which reaches the inside of an apparatus exterior body through a pipe fixed to the apparatus exterior body, a C-type or an E-type retainer ring which is engaged with an end of the pipe is mounted.

On the premise of such a constitution, a conventional portable apparatus includes a locking member which prevents an erroneous operation of the push button. The locking member has a female threaded portion formed on the inner periphery thereof threadedly engaged with a male threaded portion formed on the outer periphery of the pipe fixed to the apparatus exterior body, and the locking member is movable between a locked position and an unlocked position by a change in meshing engagement of these threaded portions (see JP-A-2003-7164 (patent literature 1), for example).

In such a constitution, when the locking member is moved to the unlocked position, the locking member is moved away from a head of the push button which passes through the pipe. Accordingly, a pushing operation of the push button is allowed with a stroke corresponding to a distance by which the locking member is moved away from the head. To the contrary, when the locking member is moved to the locked position, the locking member is brought into a state where the locking member is in contact with the head of the push button. Due to such a constitution, forced pushing of the push button can be prevented.

Further, there has been also known a prior art where the external appearance of the push button does not change between a locked state and an unlocked state and, further, the intrusion of debris into the female and male threaded portions is made difficult even in a locked state (see JP-A-2004-319446 (patent literature 2), for example).

In such prior art, the locking member is axially movably fitted on the outer periphery of the pipe fixed to the apparatus exterior body, and a rotary ring which covers the locking member is held such that the rotary ring is not axially movable with respect to the pipe. A female threaded portion formed on the inner periphery of the rotary ring is threadedly engaged with the male threaded portion formed on the outer periphery of the locking member. Due to such a constitution, the locking member can be moved between a locked position and an unlocked position by changing meshing engagement of these threaded portions.

In such a constitution, when the locking member is moved to an unlocked position along with the rotational operation of the rotary ring, the locking member is moved away from the head of the push button which passes through the pipe. Accordingly, the pushing operation of the push button is allowed with a stroke corresponding to the spaced-apart distance between the locking member and the head. To the contrary, when the locking member is moved to a locked position due to the rotation of the rotary ring, the locking member is brought into a state where the locking member is in contact with the head of the push button. Accordingly, the forced pushing of the push button is prevented.

In the prior art, the push button is positioned due to the engagement of the retainer ring mounted on the push button with the end of the pipe in the inside of the apparatus exterior body, and the locking member moved to the locked position is brought into contact with the head of the push button in such a state. Due to such a constitution, even in a state where the push button is locked, a state where the male threaded portion and the female threaded portion are engage with each other is maintained.

There may be a case where, after the locking member reaches the locked position, the locking member having the female threaded portion or the rotary ring is further rotatably operated excessively due to an operator's error.

Such an erroneous operation may occur due to the following reason. That is, the strength of the retainer ring is not so large, and the retainer ring is elastically deformable relatively easily. Further, the retainer ring has a slit so that the retainer ring is deformable in order to shrink a diameter thereof. Accordingly, it is scarcely possible for a user to perceive that the locking member has reached the locked position due to the elastic deformation of the retainer ring. Accordingly, the locking member or the rotary ring may be in error operated as described previously.

When the locking member or the rotary ring is rotatably operated excessively in error, there may be a case where the deformed retainer ring is pulled into the inside of the pipe along with such a rotary operation. As a result, there may be a case where the smooth movement of the push button in the axial direction is impaired after the erroneous operation. Particularly, when the locking member or the rotary ring is designed so as to have a larger outer diameter for enhancing the operability of the locking member or the rotary member, a rotational torque caused by the above-mentioned erroneous operation is increased. Along with the increase of the rotational torque, the retainer ring is more easily deformed thus increasing a possibility that the retainer ring will be pulled into the inside of the pipe. Further, the drawbacks brought about by the above-mentioned erroneous operation become a cause of impairment in designing the locking member or the rotary ring with a larger outer diameter.

As a countermeasure to cope with the above-mentioned drawbacks, it may be considered that a wall thickness of a retainer ring is increased or a retainer ring is made of a material having high strength so as to make the deformation of the retainer ring difficult. However, such a countermeasure uses a dedicated retainer ring which is yet to be developed and hence, a manufacturing cost is pushed up. In addition, an operation of mounting a retainer ring on a shaft portion of a push button or an operation of removing the retainer ring from the shaft portion of the push button becomes cumbersome so that operability is largely lowered when a push button and parts around the push buttons are disassembled and cleaned. Accordingly, the above-mentioned countermeasures are not desirable.

SUMMARY OF THE INVENTION

It is an object of the present invention to provide a portable apparatus and a portable timepiece which can, in a state where a locking member is moved to a locked position where pushing of a push button is prevented, prevent the locking member from being rotatably operated excessively in error.

To achieve the above-mentioned object, a portable apparatus of the present invention includes: an apparatus exterior body in which a through hole is formed; a pipe which includes an insertion sleeve portion which is inserted into the through hole and is fixed to the apparatus exterior body, and an externally arranged sleeve portion which is arranged outside the apparatus exterior body integrally with the insertion sleeve portion and on which a male threaded portion and a stopper portion are formed; a locking member which includes: a locking portion which is brought into contact with or is separated from the stopper portion; a recessed portion for button pushing, and a female threaded portion respectively, has the female threaded portion thereof threadedly engaged with the male threaded portion, and is mounted in a movable state in the axial direction of the pipe while covering the externally arranged sleeve portion; a push button which includes: a shaft portion which passes through the pipe; and a head which has an opposedly facing portion which opposedly faces a bottom surface of the recessed portion and is positioned outside the apparatus exterior body, and is provided in a movable state in the axial direction, a spring which biases the push button toward the outside of the apparatus exterior body, and a retainer ring which is mounted on a shaft end portion of the shaft portion which is positioned in the inside of the apparatus exterior body and prevents the removal of the push button from the pipe, wherein a spaced-apart distance A between the stopper portion and the locking portion which opposedly faces the stopper portion in a state where the locking member is positioned by being brought into contact with the apparatus exterior body and a spaced-apart distance B between the bottom surface and the opposedly facing portion in the same state are set to satisfy the relationship of $A \leq B$.

The portable apparatus according to the present invention is applicable to a portable timepiece such as a wrist watch or a pocket watch, a stop watch, a mobile phone, a personal digital assistant or the like, and the apparatus exterior body means an exterior casing or the like. In the present invention, the stopper portion of the pipe may be integrally formed with the externally arranged sleeve portion of the pipe or may be formed of a structure which is mounted on the outer periphery of the externally arranged sleeve portion as a separate part the externally arranged sleeve portion. In the present invention, the locking portion of the locking member may be formed of an annular portion which is formed on the inner periphery of the locking member without being interrupted in the circumferential direction or another annular portion which is formed in substantially same manner may play a role of the locking portion.

In the present invention, the opposedly facing portion which the head of the push button has may preferably be formed by making use of an end surface on a back side of the head. However, the outer periphery of a peripheral portion of the head may be cut from a back side opposite to a front side of the head, and a surface contiguously formed at a right angle with respect to a proximal portion of an annular thin-wall peripheral portion formed by such cutting may be used as the opposedly facing portion. Further, there is no problem in forming the opposedly facing portion by a constitutional part other than a surface. In the present invention, a C-type retainer ring or an E-type retainer ring may be used as the retainer ring.

In the present invention, "the spring biases the push button toward the outside of the apparatus exterior body" means that the spring biases the push button upwardly in a case where the push button is provided to be pushed from a front surface of the apparatus exterior body, or means that the spring biases the push button outwardly in a case where the push button is pushed from a side surface of the apparatus exterior body.

In the present invention, when the locking member is rotatably operated by a user or the like, the locking member is moved between an unlocked position and a locked position along with a change in meshing engagement between the female threaded portion of the locking member and the male threaded portion of the pipe.

In a state where the locking member is moved to an unlocked position, the locking portion of the locking member is away from the stopper portion of the pipe. Along with such an operation, in the same state, the bottom surface of the recessed portion for button pushing which the locking member has is away from the opposedly facing portion of the head which the push button has. Accordingly, the push button can perform a pushing operation. Using the shaft portion of the pushed push button, a button response member such as a contact, for example, arranged in the inside of the apparatus exterior body can be operated.

In a state where the locking member is moved to a locked position, the bottom surface of the recessed portion for button pushing which the locking member has is close to or is brought into contact with the opposedly facing portion of the head which the push button has. Accordingly, the bottom surface of the recessed portion for button pushing functions as a stopper and holds the push button such that the push button is not pushed.

Along with such an operation, in a state where the locking member is moved to a locked position, the locking portion of the locking member is brought into contact with the stopper portion of the pipe. Since the insertion sleeve portion of the pipe is fixed to the apparatus exterior body, eventually, due to the contact (engagement) between the locking portion and the stopper portion, the locking member is held on the apparatus exterior body in a positioned state such that the further separation of the locking member from the apparatus exterior body is prevented.

Accordingly, even when a user or the like attempts to further rotate the locking member which is moved to a locked position, it is possible to prevent the locking member from being rotated in the wrong direction. That is, it is possible to prevent an erroneous operation of the locking member which is moved to a locked position.

In this case, even when it is assumed that slight rotation of the locking member is allowed due to a play in meshing engagement at a threadedly engaging portion between the female threaded portion and the male threaded portion, a force which intends to move the locking member is supported by the apparatus exterior body by way of the pipe. Accordingly, it is possible to prevent the bottom surface of the recessed portion for button pushing from strongly pushing the opposedly facing portion of the push button.

Therefore, according to the present invention, it is possible to prevent an overload from being applied to the retainer ring by way of the push button and hence, it is possible to eliminate a possibility that the retainer ring will be deformed and will be pulled into the inside of the pipe.

The preferred mode of the portable apparatus according to the present invention is characterized in that, in the above-mentioned invention, the spaced-apart distance B is set larger than the spaced-apart distance A.

In this preferred embodiment, in a state where the locking member is positioned by the stopper portion, a gap is formed between the bottom surface of the recessed portion for button pushing and the opposedly facing portion of the push button. Accordingly, even when there is a play in meshing engagement between the male threaded portion of the pipe and the female threaded portion of the locking member and the locking member arranged at a locked position is rotatably operated in the wrong direction due to such a play, there is no possibility that the locking member pushes the opposedly facing portion of the push button. Accordingly, it is possible to more surely eliminate a possibility that the retainer ring will be deformed and will be pulled into the inside of the pipe.

The preferred mode of the portable apparatus according to the present invention is characterized in that the stopper portion is formed of a ring which is formed as a separate part the externally arranged sleeve portion and allows the shaft portion and the spring to pass therethrough, and is removably threadedly engaged with the externally arranged sleeve portion.

In this preferred mode, in the above-mentioned invention, by removing the stopper portion which the pipe includes from the externally arranged sleeve portion of the pipe fixed to the apparatus exterior body, the locking member including the locking portion which is brought into contact with or is separated from the stopper portion can be removed from the externally arranged sleeve portion. Accordingly, the threadedly engaging portion between the male threaded portion and the female threaded portion can be disassembled and cleaned.

The preferred mode of the portable apparatus according to the present invention is, in the above-mentioned invention, further characterized in that the externally arranged sleeve portion includes a large-diameter portion and a small-diameter portion which is continuously formed with the large-diameter portion, the male threaded portion is formed on the large-diameter portion, another male threaded portion having a smaller diameter than the male threaded portion is formed on the small-diameter portion, and the stopper portion is threadedly engaged with another male threaded portion.

In the preferred embodiment, the stopper portion is threadedly engaged with the outer periphery of the small-diameter portion of the externally arranged sleeve portion and hence, an inner diameter of the locking member which covers the stopper portion can be made small whereby an outer diameter of the locking member can be also made small correspondingly. Accordingly, in embodying the portable apparatus as a portable apparatus where an outer diameter of a locking member manually rotatably operated is required to be small such as, for example, a portable timepiece having small thickness, this mode of the present invention is preferably applicable to the portable apparatus.

In the preferred mode of the portable apparatus according to the present invention is, in the above-mentioned invention, characterized in that an outer peripheral diameter of the externally arranged sleeve portion is equal over respective portions of the externally arranged sleeve portion, the male threaded portion is formed over a substantially total length of the externally arranged sleeve portion, and the locking member and the stopper portion are threadedly engaged with the male threaded portion respectively.

In this preferred mode, the stopper portion is threadedly engaged with the male threaded portion which defines the largest outer diameter of the externally arranged sleeve portion and hence, the inner diameter of the locking member which covers the stopper portion also becomes large whereby the outer diameter of the locking member also becomes large. Accordingly, in embodying the portable apparatus as a portable apparatus where an outer diameter of a locking member manually rotatably operated is required to be large such as, for example, a portable timepiece having a large thickness, this mode of the present invention is preferably applicable to the portable apparatus.

Together with such an advantageous effect, a torque in rotatably operating the locking member is increased so that the operability of the locking member can be enhanced. Regardless of the enhancement of the operability of the locking member, it is possible to prevent a force which draws the retainer ring into the inside of the pipe from being applied to the push button as described above. Further, it is sufficient to perform thread forming working to the outer periphery of the externally arranged sleeve portion of the pipe only one time and hence, a pipe working cost can be reduced.

The preferred mode of the portable apparatus according to the present invention is, in the above-mentioned invention, further characterized in that the female threaded portion is formed on the inner periphery of the locking portion.

In this preferred mode, it is possible to omit working for forming a locking portion on the locking member in addition to the female threaded portion parallel to the female threaded portion. Accordingly, a locking member working cost can be reduced.

The preferred mode of the portable apparatus according to the present invention is, in the above-mentioned invention, further characterized in that a mark is mounted on the head, the mark being exposed from a distal end of the locking member in a state where the locking member is positioned by being brought into contact with the apparatus exterior body and being covered with a distal end portion of the locking member in a state where the locking portion is brought into contact with the stopper portion or is separated from the stopper portion.

In this preferred mode, when the push button is pushed into against the spring, the mark on the head is arranged in a retracted manner inside the locking member. On the other hand, when the push button is pushed back due to a force of the spring, the mark on the head is arranged outside the locking member. Accordingly, using such a mark, it is possible to inform a user of the completion of pushing of the push button or whether or not the push button is pushable.

To achieve the above-mentioned object, a portable timepiece according to the present invention is formed of the portable apparatus according to any one of the above-mentioned respective inventions.

According to the present invention, the portable timepiece according to the present invention is formed of the portable apparatus according to any one of the above-mentioned respective inventions. Accordingly, it is possible to provide the portable timepiece which can, in a state where a locking member is moved to a locked position where pushing of a push button is prevented, prevent the locking member from being rotatably operated excessively in error.

According to the present invention, the portable apparatus or the portable timepiece is configured such that, when the locking member is moved to a locked position where the locking member prevents the pushing of the push button, the locking member is positioned on the apparatus exterior body by way of the pipe fixed to the apparatus exterior body thus preventing the further movement of the locking member. Accordingly, it is possible to provide the portable apparatus or the portable timepiece which can prevent the locking member in a state where the locking member is moved to the locked position from being rotatably operated excessively in error.

DETAILED DESCRIPTION OF THE PREFERRED EMBODIMENTS

The first embodiment of the present invention is explained in conjunction with FIG. 1 to FIG. 4.

In FIG. 1 to FIG. 4, symbol 11 indicates a potable apparatus such as a portable timepiece, to be more specific, a wrist watch which is used as a waterproof timepiece. The timepiece 11 includes an apparatus exterior body, for example, a timepiece exterior body 12.

Figure 3:
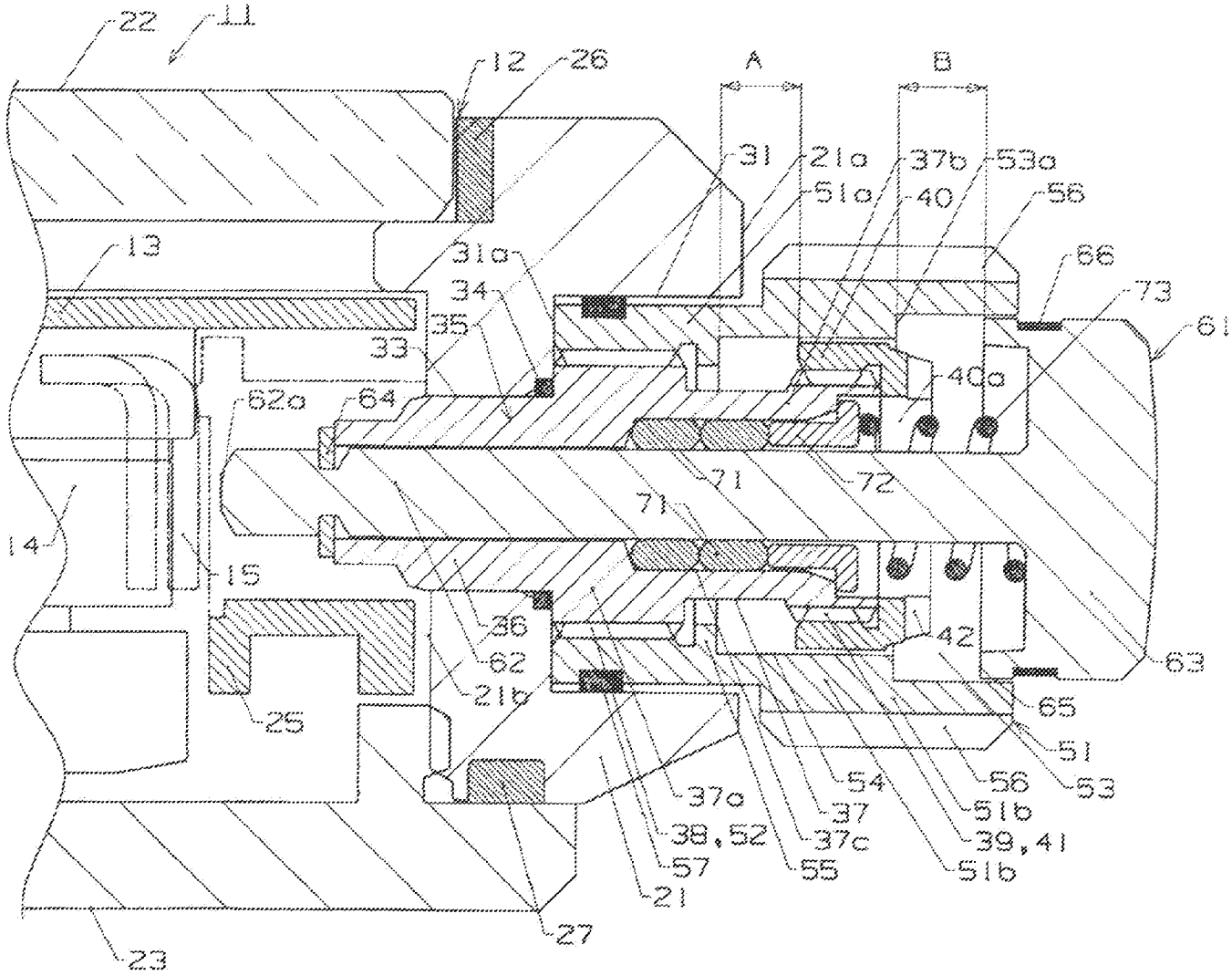
FIG. 3 is a cross-sectional view taken along a line F-F in FIG. 1 in a state where a push button which the wrist watch shown in FIG. 1 includes is pushable.
Figure 4:
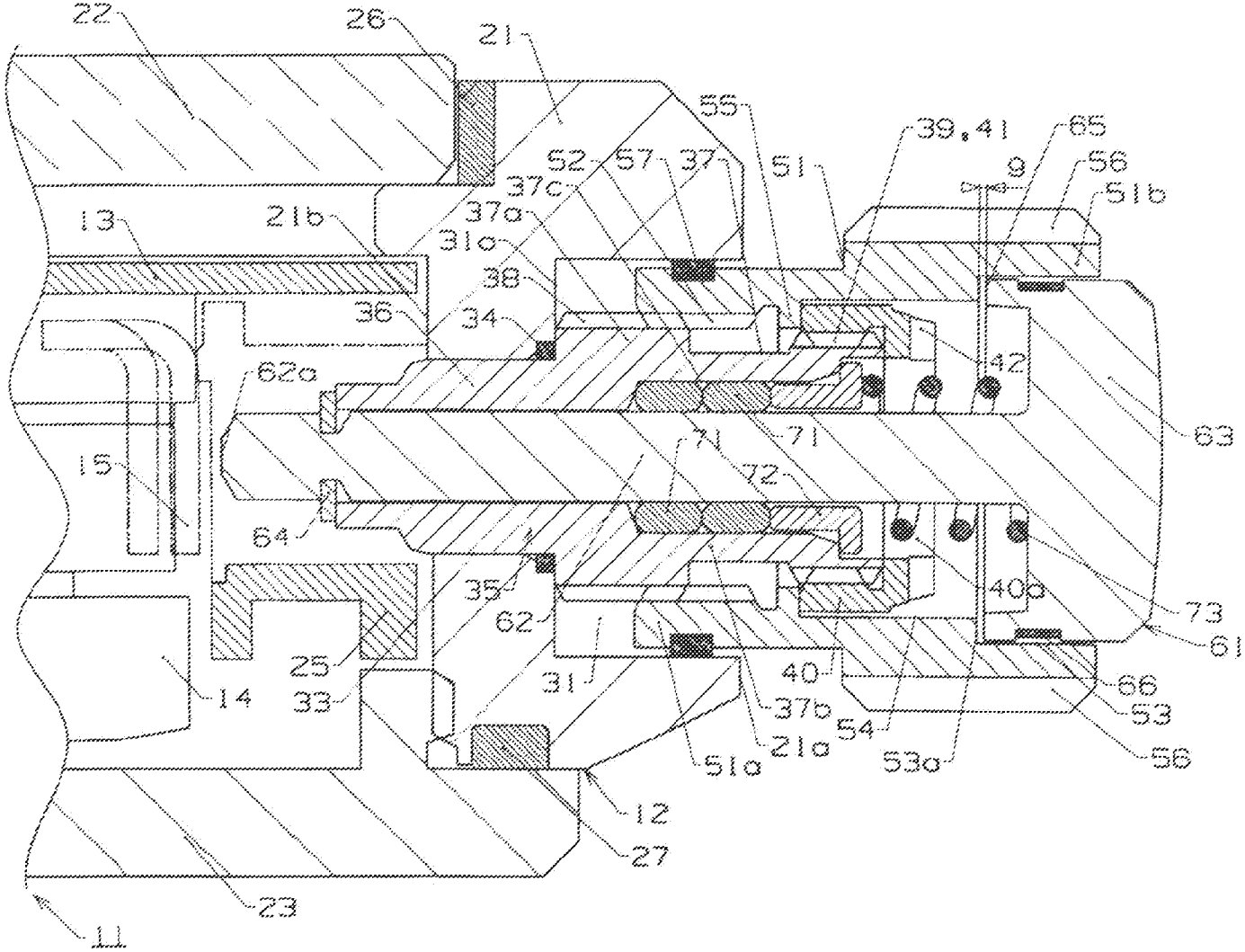
FIG. 4 is a cross-sectional view taken along a line F-F in FIG. 1 in a state where pushing of the push button which the wrist watch shown in FIG. 1 includes is prevented.

As shown in FIG. 3 and FIG. 4, in the inside of the timepiece exterior body 12, predetermined members are housed. The predetermined members include: a display board such as a dial 13, for example; an apparatus which controls a display such as a movement 14 which controls the movement of time indicating pointers, for example; a lamp not shown in the drawing; and a battery not shown in the drawing which is provided as a power source.

Figure 1:
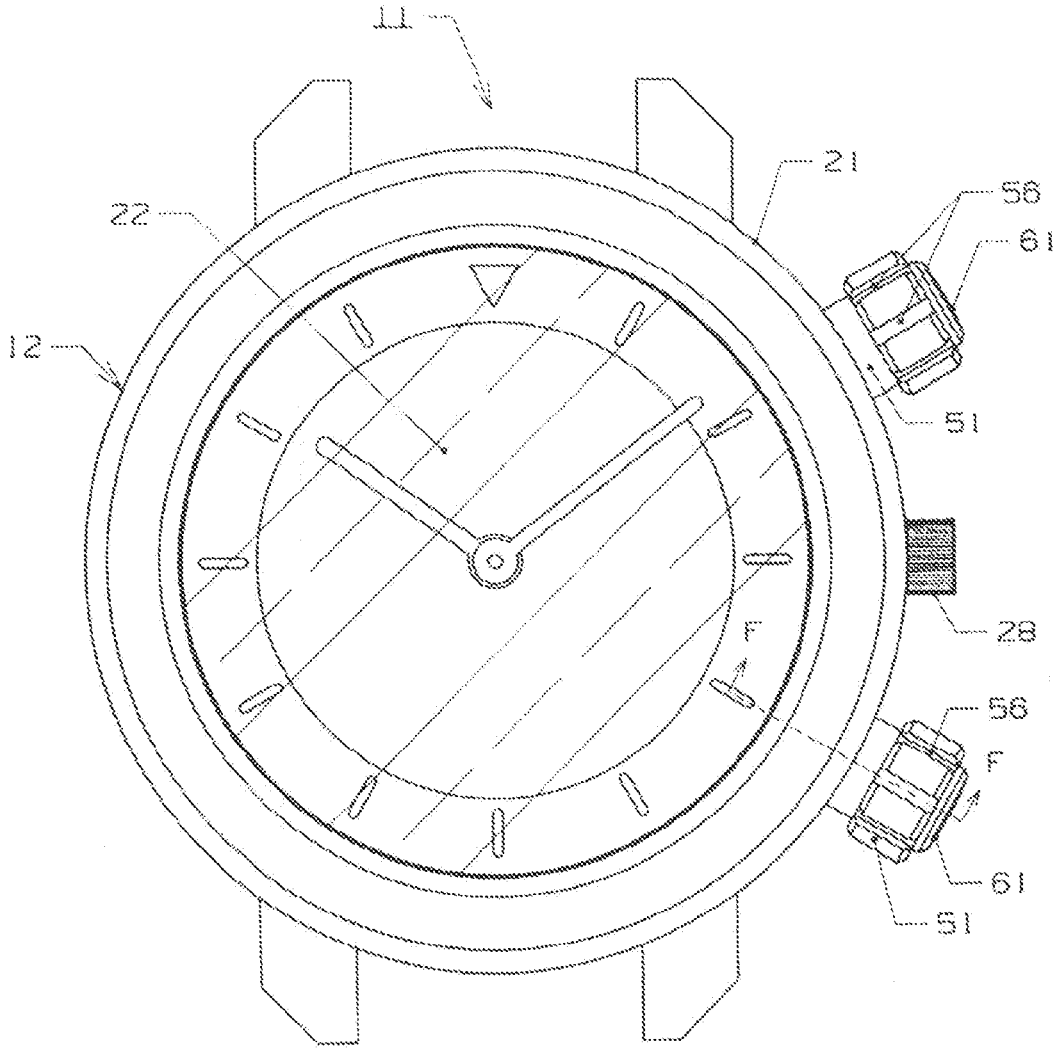
FIG. 1 is a front view showing a wrist watch according to a first embodiment of the present invention.
Figure 2:
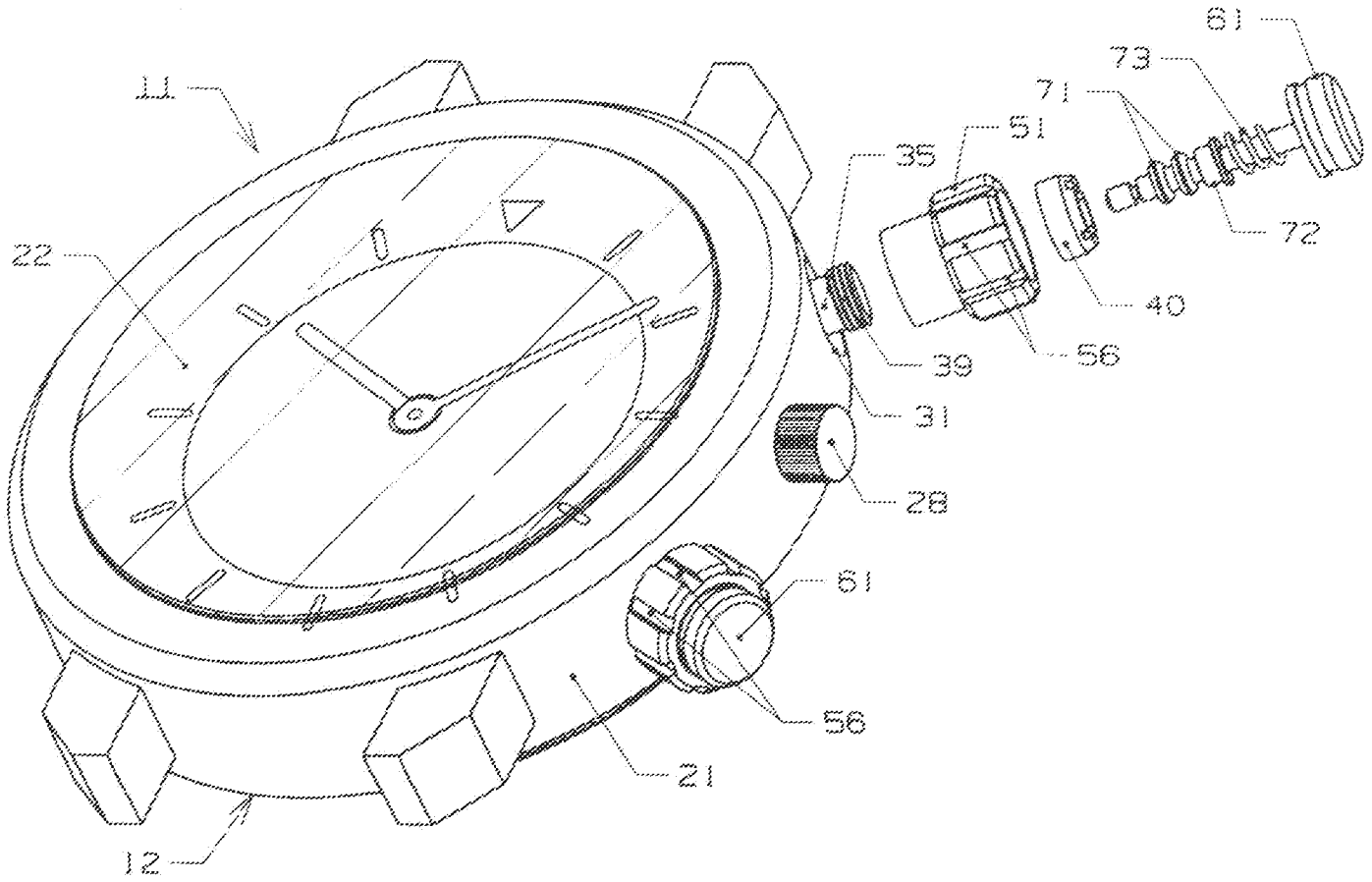
FIG. 2 is a perspective view showing the wrist watch shown in FIG. 1 with a part exploded.

The movement 14 includes at least one, for example, two button response members, for example, contacts 15 (only one contact shown in FIG. 2 and FIG. 4). Each contact 15 is formed of a leaf spring or the like and projects from the outer periphery of the movement 14. The movement 14 or the like is configured to perform a function allocated to respective push buttons 61 when the contact 15 is pushed by the push button 61 described later. For example, the push button 61 shown in FIG. 1 and in a right upper side of the FIG. 2 plays a start/stop function, and the push button 61 shown in FIG. 1 and in a right lower side of FIG. 2 plays a function of turning on or off the lamp.

As shown in FIG. 3 and FIG. 4, the timepiece exterior body 12 is formed such that a cover glass 22 which allows the viewing of the dial 13 in a see-through manner is liquid-tightly mounted on a front surface of an annular barrel 21 which is made of metal such as stainless steel or titanium, and a back lid 23 which is made of metal, a synthetic resin or the like is liquid-tightly mounted on a back surface of the barrel 21.

In FIG. 3 and FIG. 4, symbol 25 indicates a middle frame which supports the movement 14 thereon. Further, in FIG. 3 and FIG. 4, symbols 26, 27 respectively indicate a packing for holding the liquid tightness of the timepiece exterior body 12. In FIG. 1 and FIG. 2, symbol 28 indicates a crown.

Next, the constitution where the push buttons 61 described later are arranged on predetermined portions of the timepiece exterior body 12, for example, two portions of the barrel 21 which constitutes a side wall of the timepiece exterior body 12 is explained. Both push buttons 61 have the same constitution and are also arranged on the timepiece exterior body 12 in the same manner. Accordingly, in this embodiment, the explanation is made by taking, as the representative example, the constitution where the push button 61 having a function of turning on/off the lamp which illuminates the dial 13 is arranged on the barrel 21 in conjunction with FIG. 3 and FIG. 4.

The barrel 21 includes a recessed portion 31 and a through hole 33. The recessed portion 31 is formed such that the recessed portion 31 opens on a barrel outer surface (outer surface of the exterior body) 21*a* of the barrel 21. The through hole 33 is formed such that one end of the through hole 33 opens on a bottom surface of the recessed portion 31 and the other end of the through hole 33 opens on an inner surface of the timepiece exterior body 12, for example, a barrel inner surface (inner surface of the exterior body) 21*b*. Both the recessed portion 31 and the through hole 33 having a smaller diameter than the recessed portion 31 have a circular shape and are arranged concentrically.

A tubular member in the form of a circular pipe 35 is fixed to the barrel 21. The pipe 35 is made of metal such as stainless steel or titanium, and is formed of an insertion sleeve portion 36 and an externally arranged sleeve portion 37 which is integrally formed with the insertion sleeve portion 36. A diameter of a distal end portion of the insertion sleeve portion 36 is narrowed. Here, when a stopper portion 40 described later is integrally formed with the pipe 35, a material for forming the pipe 35 is not limited to metal and may be formed using a synthetic resin as a material thereof.

Male threaded portions 38, 39 and the stopper portion 40 are formed on the outer periphery of the externally arranged sleeve portion 37.

The externally arranged sleeve portion 37 includes a large-diameter portion 37*a* and a small-diameter portion 37*b* which is continuously formed with the large-diameter portion 37*a*. The large-diameter portion 37*a* has a diameter larger than the largest outer diameter of the insertion sleeve portion 36, and is continuously formed with the insertion sleeve portion 36. The small-diameter portion 37*b* is continuously formed with the large-diameter portion 37*a* on a side opposite to the insertion sleeve portion 36 with the large-diameter portion 37*a* set as a boundary. An outer diameter of the small-diameter portion 37*b* is substantially equal to the largest outer diameter of the insertion sleeve portion 36. A packing accommodating groove 37*c* is formed on an inner surface of the externally arranged sleeve portion 37, and the packing accommodating groove 37*c* opens on a distal end of the externally arranged sleeve portion 37.

The insertion sleeve portion 36 of the pipe 35 is inserted into the through hole 33 from the outside of the barrel 21. In this case, the insertion sleeve portion 36 is inserted into the through hole 33 until the large-diameter portion 37*a* is brought into contact with a bottom surface 31*a* of the recessed portion 31, and the narrow-diametered distal end portion of the insertion sleeve portion 36 projects into the inside of the barrel 21, for example. The pipe 35 is fixed to the barrel 21 using a brazing material 34 made of metal. The brazing material 34 is fitted in an annular groove formed on a corner portion which is formed by the bottom surface 31*a* of the recessed portion 31 and the through hole 33.

The externally arranged sleeve portion 37 of the pipe 35 which is fixed to the timepiece exterior body 12 as described above is positioned at a center portion of the recessed portion 31 and is arranged outside the barrel 21, that is, outside the timepiece exterior body 12. The male threaded portion 38 is formed on an outer peripheral portion of the large-diameter portion 37*a* of the externally arranged sleeve portion 37. The male threaded portion 38 is provided for advancing and retracting a locking member 51 described later in the axial direction. Further, another male threaded portion 39 is formed on an outer peripheral portion of the small-diameter portion 37*b* of the externally arranged sleeve portion 37. Another male threaded portion 39 is provided for mounting the stopper portion 40 on the externally arranged sleeve portion 37.

The stopper portion (stopper) 40 is formed of a separate part from the externally arranged sleeve portion 37, for example. The stopper portion (stopper) 40 is formed of a stopper ring which is made of metal and has a center hole 40*a*, and has an outer diameter thereof larger than an outer diameter of the male threaded portion 38. A diameter of the center hole 40*a* is substantially equal to a diameter of an open end of the packing accommodating groove 37*c*.

A female threaded portion 41 is formed on an inner peripheral surface of the stopper portion 40. By threadedly engaging the female threaded portion 41 with another male threaded portion 39 formed on the distal end portion of the externally arranged sleeve portion 37, the stopper portion 40 is mounted such that the stopper portion 40 covers the distal end portion of the externally arranged sleeve portion 37. In this case, a bottom wall of the stopper portion 40 is brought into contact with the distal end of the externally arranged sleeve portion 37 and hence, the stopper portion 40 is positioned in the axial direction of the externally arranged sleeve portion 37. The center hole 40*a* of the stopper portion 40 which is mounted as described above is continuously formed with the packing accommodating groove 37*c*.

Grooves 42 are formed on an outer surface of the bottom wall of the stopper portion 40, and the grooves 42 are formed so as to intersect with each other in a cruciform. The stopper portion 40 can be rotated in a state where a tool is engaged with the grooves 42. Accordingly, the stopper portion 40 is removably threadedly engaged with the externally arranged sleeve portion 37.

The locking member 51 which covers the externally arranged sleeve portion 37 is movably mounted on the externally arranged sleeve portion 37 such that the locking member 51 is movable in the axial direction of the pipe 35.

To be more specific, the locking member 51 is formed of a metal ring having a small-diameter portion 51*a* and a large-diameter portion 51*b* so that an outer peripheral surface of the locking member 51 is formed into a stepped shape. The locking member 51 includes: a female threaded portion 52; a recessed portion 53 for button pushing; an intermediate recessed portion 54, and a locking portion 55.

The female threaded portion 52 is formed on an inner surface of the small-diameter portion 51*a*. The recessed portion 53 is formed on an inner surface of the large-diameter portion 51*b* concentrically with the large-diameter portion 51*b*, and opens on an end surface of the large-diameter portion 51*b*.

The intermediate recessed portion 54 is formed between the female threaded portion 52 and the recessed portion 53, and is continuously formed with a bottom surface 53*a* of the recessed portion 53 at a right angle. Accordingly, the bottom surface 53*a* of the recessed portion 53 forms a step between the inner peripheral surface of the recessed portion 53 and the intermediate recessed portion 54. An inner diameter of the recessed portion 53 for button pushing and an inner diameter of the intermediate recessed portion 54 are larger than an inner diameter of the female threaded portion 52. The inner diameter of the recessed portion 53 is slightly larger than an outer diameter of a head 63 described later. The inner diameter of the intermediate recessed portion 54 is smaller than the inner diameter of the recessed portion 53 and is slightly larger than an outer diameter of the locking member 51.

The locking portion 55 is provided between the female threaded portion 52 and the intermediate recessed portion 54. The locking portion 55 is formed of an annular projecting portion which is continuously formed in the circumferential direction of the locking member 51 without interruption and partitions a bottom of the intermediate recessed portion 54.

The locking member 51 is mounted on the externally arranged sleeve portion 37 by threadedly engaging the female threaded portion 52 thereof with the male threaded portion 38 of the pipe 35, and covers the externally arranged sleeve portion 37. The small-diameter portion 51*a* of the locking member 51 is accommodated in the recessed portion 31. The large-diameter portion 51*b* of the locking member 51 is arranged outside the recessed portion 31. In a state where the locking member 51 is supported on the pipe 35 as described above, the locking portion 55 of the locking member 51 is arranged between the threadedly engaging portion formed by the male threaded portion 38 and the female threaded portion 52 and the stopper portion 40.

On the outer periphery of a distal end portion of the small-diameter portion 51*a*, a dust-proof and water-proof packing 57 which seals a gap formed between the outer periphery and an inner peripheral surface of the recessed portion 31 is mounted. On the outer periphery of the large-diameter portion 51*b*, a plurality of splines 56 which prevent a users' finger from being slipped when a user rotatably operates the locking member 51 with his hand are formed parallel to the axial direction of the locking member 51.

The pushbutton 61 is supported on the pipe 35. The push button 61 is an integrally formed product made of metal or a synthetic resin, and includes a shaft portion 62 and the head 63.

The shaft portion 62 has a columnar shape, and a length of the shaft portion 62 is larger than an axial length of the pipe 35. The shaft portion 62 passes through the pipe 35 in an axially movable manner, and a retainer ring 64 which prevents the removal of the push button 61 from the pipe 35 is mounted on a shaft end portion (distal end portion) of the shaft portion 62 which projects toward the inside of the barrel 21. The retainer ring 64 is made of metal and is of a C type or an E type, and has a size by which the retainer ring 64 is engaged with an end surface of the insertion sleeve portion 36 which projects to the inside of the barrel 21.

An outer diameter of the head 63 which is integrally formed with the other shaft end of the shaft portion 62 is slightly smaller than the inner diameter of the recessed portion 53 for button pushing. The head 63 includes an opposedly facing portion 65. The opposedly facing portion 65 is formed of an end surface on a back side of the head 63, for example. Further, an indicator mark 66 is provided on the outer periphery of the head 63. The mark 66 is formed in such a manner that, an annular groove is continuously formed on an outer peripheral surface of the head 63 in the circumferential direction of the head 63, and a paint of color different from a ground color of metal from which the head 63 is made is applied to a bottom of the annular groove by painting.

The shaft portion 62 of the push button 61 is inserted into and is made to pass through the pipe 35 from the outside of the barrel 21 and, thereafter, the retainer ring 64 is mounted on the shaft end portion of the shaft portion 62 which projects to the inside of the barrel 21. Due to such a constitution, the push button 61 is mounted on the pipe 35 in a state where the removal of the push button 61 from the pipe 35 is prevented. Along with such mounting, the head 63 is arranged outside the timepiece exterior body 12 in a state where the head 63 is fitted or accommodated in the recessed portion 53 for button pushing. Due to such arrangement, the opposedly facing portion 65 faces the bottom surface 53*a* of the recessed portion 53.

In the packing accommodating groove 37*c* of the pipe 35, at least one dust-proof and water-proof packing 71, for example, a plurality of packings 71 are accommodated such that the packings 71 are arranged parallel to each other in the axial direction of the pipe 35. Each packing 71 is formed into a ring shape using a rubber-based or plastic-based elastically deformable material. The packing 71 is brought into close contact with a peripheral surface of the shaft portion 62. Due to the packings 71, a gap formed between the pipe 35 and the push button 61 is sealed.

Further, a packing pusher 72 is accommodated in the packing accommodating groove 37*c*, and the packing pusher 72 is brought into contact with the outermost packing 71. A spring, for example, a coil spring 73 is sandwiched between the packing pusher 72 and the head 63 in a compressed state. The coil spring 73 can be further compressed by pushing the push button 61.

Due to a spring force of the coil spring 73, the push button 61 is biased to the outside of the timepiece exterior body 12, to be more specific, to the outside of the barrel 21. Due to such a constitution, the retainer ring 64 is held in a state where the retainer ring 64 is caught by an end surface of the pipe 35 which projects toward the inside of the timepiece exterior body 12. A spring force of the coil spring 73 pushes the respective packings 71 toward the inside of the timepiece exterior body 12 and hence, these packings 71 are more strongly brought into close contact with the shaft portion 62 thus enhancing the sealing property.

Next, the explanation is made with respect to steps of mounting various parts around the pipe 35 which is fixed to the barrel 21.

Firstly, the female threaded portion 52 of the locking member 51 is threadedly engaged with the male threaded portion 38 of the pipe 35 until the distal end of the small-diameter portion 51*a* of the locking member 51 is brought into contact with the bottom surface 31*a* of the recessed portion 31 thus covering the externally arranged sleeve portion 37 of the pipe 35 with the locking member 51.

Next, the female threaded portion 41 of the stopper portion 40 is threadedly engaged with the male threaded portion 39 of the pipe 35 until the stopper portion 40 is brought into contact with the distal end of the externally arranged sleeve portion 37 thus mounting the stopper portion 40 on the distal end portion of the externally arranged sleeve portion 37. Here, to prevent the stopper portion 40 from being inadvertently rotated after the stopper portion 40 is mounted, it is preferable to fix the female threaded portion 41 to the male threaded portion 39 by adhesion by applying an adhesive material to the female threaded portion 41 before the stopper portion 40 is threadedly engaged. In such a case, it is preferable to set an adhesive force to an extent that the threaded engagement between the female threaded portion 41 and the male threaded portion 39 can be released when necessary.

Finally, the push button 61 is mounted. That is, the coil spring 73, the packing pusher 72, and the packings 71 are fitted on the shaft portion 62 of the push button 61 in this order and, thereafter, the shaft portion 62 is made to pass through the pipe 35 from the outside of the barrel 21 while compressing the coil spring 73. Along with such an operation, the coil spring 73 and the shaft portion 62 are made to pass thorough the center hole 40*a* of the stopper portion 40. Then, the retainer ring 64 is mounted on the distal end portion of the shaft portion 62 which projects toward the inside of the barrel 21 thus preventing the removal of the push button 61.

Further, the removal of the parts around the pipe 35 in disassembling and cleaning the wrist watch 11 can be performed by taking steps opposite to the mounting steps explained heretofore. Accordingly, by removing the parts around the pipe 35, the female threaded portion 41 and the male threaded portion 39 can be cleaned, and a part such as the packing 71 can be exchanged.

In the wrist watch 11 having the above-mentioned constitution, in a usual state where the push button 61 is usable, the push button 61 is arranged at an unlocked position shown in FIG. 3 by the coil spring 73 which biases the push button 61 in the direction opposite to the pushing direction of the push-button 61 and is held in a pushable state. In this case, the retainer ring 64 is caught by the distal end portion of the insertion sleeve portion 36 thus preventing the removal of the push button 61.

In addition to such a constitution, in the usual state, the locking member 51 is threadedly engaged with the pipe 35 to a deepest position such that the distal end of the small-diameter portion 51*a* is brought into contact with the bottom surface 31*a* of the recessed portion 31 formed on the timepiece exterior body 12. Accordingly, the locking member 51 is in a state where the locking member 51 is positioned by the barrel 21 of the timepiece exterior body 12.

Further, along with the threaded engagement of the locking member 51 with the pipe 35 to a deepest position, most of the head 63 of the push button 61 projects toward the outside of the locking member 51 relative to the locking member 51 and hence, a user can visually recognize the mark 66. Accordingly, a user who visually recognizes the indicator mark 66 knows that the push button 61 is in a pushable state.

In such a usual state, the locking portion 55 of the locking member 51 is arranged close to the male threaded portion 38 of the pipe 35, and is remotest from the stopper portion 40 of the pipe 35. Assume a spaced-apart distance in the axial direction (i.e., the direction of inward/outward movement of the push button 61) between the stopper portion 40 and the locking portion 55 which faces the stopper portion 40 in an opposed manner in such a state as A. Due to such a spaced-apart distance A, in the above-mentioned usual state, the bottom surface 53*a* of the recessed portion 53 of the locking member 51 is remotest from the opposedly facing portion 65 which the head 63 of the push button 61 has. Assume a spaced-apart distance in the axial direction between the bottom surface 53*a* and the opposedly facing portion 65 in such a state as B. The spaced-apart distance A and the spaced-apart distance B in the usual state is set to satisfy the relationship of A?B, and, in the first embodiment, the spaced-apart distance A and the spaced-apart distance B are set to satisfy the relationship of A<B as a preferred example.

By setting the spaced-apart distance A and the spaced-apart distance B as described above, the push button 61 can be pushed. A push stroke of the push button 61 is defined by at least the spaced-apart distance A out of the spaced-apart distance A and the spaced-apart distance B.

When the push button 61 is pushed into the timepiece exterior body 12 from the outside of the barrel 21 against a spring force of the coil spring 73, the distal end 62*a* of the shaft portion 62 pushes the contact 15 which is arranged so as to face the distal end 62*a* in an opposed manner. Due to such a pushing operation, the movement 14 is operated such that a function allocated to the push button 61 is performed. Thereafter, along with the release of the pushing of the push button 61, the push button 61 is pushed back to an original state by a spring force of the coil spring 73.

Further, to prevent the push button 61 from being inadvertently pushed during carrying the wrist watch 11 or the like, it is sufficient to rotate the locking member 51 in the direction that the locking member 51 is loosened. Meshing engagement between the male threaded portion 39 and the female threaded portion 52 is changed along with such rotation and hence, the locking member 51 is moved in the axial direction such that the locking member 51 is moved away from the bottom surface 31*a* of the recessed portion 31 and projects from the barrel 21 of the timepiece exterior body 12.

Such movement of the locking member 51 is prevented when the locking member 51 is brought into contact with stopper portion 40 of the pipe 35 in a state where the locking portion 55 of the locking member 51 is caught by the stopper portion 40 of the pipe 35 so that the further rotational operation of the locking member 51 is not allowed. FIG. 4 shows a state where the locking member 51 is moved to a locked position. In this state, when the push button 61 receives a pushing force, due to the contact between the opposedly facing portion 65 of the head 63 and the bottom surface 53*a* of the recessed portion 53 for button pushing, pushing of the push button 61 is prevented.

Further, as the locking member 51 projects most deeply with respect to the barrel 21 due to the rotation thereof, most of the head 63 of the push button 61 is accommodated in the inside of the recessed portion 53 of the locking member 51 relatively so that the mark 66 is concealed by the large-diameter portion 51*b* which constitutes the distal end portion of the locking member 51. Since the mark 66 is concealed in this manner, a user knows that the push button 61 is in a state where the push button 61 cannot be pushed.

The pipe 35 is fixed to the barrel 21 of the timepiece exterior body 12 by brazing. Accordingly, a load which is applied to the stopper portion 40 when the locking member 51 is moved to a locked position can be supported by the barrel 21 by way of the pipe 35. Accordingly, the stopper portion 40 is not moved. Further, both the stopper portion 40 and the locking portion 55 are continuously formed in the circumferential direction without interruption and hence, these parts have considerably large strength compared to the retainer ring 64 whereby these parts are hardly deformed. Accordingly, there is no possibility that the stopper portion 40 and the locking portion 55 are deformed.

Accordingly, the reliability that the stopper portion 40 and the locking portion 55 stop the axial movement of the locking member 51 when the locking member 51 is arranged at the locked position is high. Due to such stopping with high reliability, it is possible to more clearly inform a user of a time that the rotary operation of the locking member 51 is finished. In addition, an outer diameter of the large-diameter portion 37*a* of the locking member 51 can be enlarged due to such enhancement of the reliability. By adopting such a constitution, the operability in rotating the locking member 51 can be further improved.

Further, in the first embodiment, the spaced-apart distance B is set larger than the spaced-apart distance A. Accordingly, in a state where the locking portion 55 is caught by the stopper portion 40 so that the locking member 51 is arranged at a locked position, as shown in FIG. 4, a slight gap g is ensured between the bottom surface 53*a* of the recessed portion 53 for button pushing and the opposedly facing portion 65 of the head 63.

It is considered that a moving amount of the locking member 51 in the direction that the locking member 51 is moved away from the barrel 21 becomes slightly increased because of irregularities in size accuracy of the male threaded portion 38 of the pipe 31 and the female threaded portion 52 of the locking member 51, irregularities in the fixed position of the stopper portion 40 with respect to the pipe 35 and the like. However, even in such a state, due to the presence of the gap g, it is possible to prevent the bottom surface 53*a* from being brought into contact with the opposedly facing portion 65 and hence, the locking member 51 can be held in a state where the locking member 51 does not interfere with the head 63 of the push button 61.

As described above, the excessively large rotational operation of the locking member 51 can be prevented, and also even when some irregularities exist in a moving amount of the locking member 51, there is no possibility that the locking member 51 which is moved to a locked position interferes with the head 63 of the push button 61 so that the push button 61 is pushed toward the outside of the barrel 21.

Due to such a constitution, there is no possibility that the retainer ring 64 mounted on the shaft portion 62 is pulled into the inside of the pipe 35 along with the deformation of the retainer ring 64. Therefore, there is also no possibility that the push button 61 is inadvertently removed. Accordingly, the above-mentioned mechanism can enhance reliability as a locking mechanism for the push button 61 in a water-proof timepiece such as a divers' watch.

As described above, there is no possibility that the retainer ring 64 is pulled into the inside of the pipe 35 and hence, there is no possibility that a pushing operation of the push button 61 is obstructed in a state where the locking member 51 is returned to an unlocked position. Accordingly, a pushing operation of the push button 61 can be performed smoothly.

As has been explained heretofore, the externally arranged sleeve portion 37 of the pipe 35 includes the large-diameter portion 37*a* and the small-diameter portion 37*b* which is continuously formed with the large-diameter portion 37*a*, the male threaded portion 38 is formed on the large-diameter portion 37*a*, the other male threaded portion 39 having a diameter smaller than a diameter of the male threaded portion 38 is formed on the small-diameter portion 37*b*, and the stopper portion 40 is threadedly engaged with the other male threaded portion 39.

As described above, the stopper portion 40 is threadedly engaged with the outer periphery of the small-diameter portion 37*b* of the externally arranged sleeve portion 37. Accordingly, an inner diameter of the intermediate recessed portion 54 formed on the locking member 51 which covers the stopper portion 40 can be made small and hence, an outer diameter of the locking member 51 can be made small correspondingly. The above-mentioned constitution is preferably applicable to a wrist watch having a small thickness which includes the push button 61 and is required to set an outer diameter of the locking member 51 small.

Figure 5:
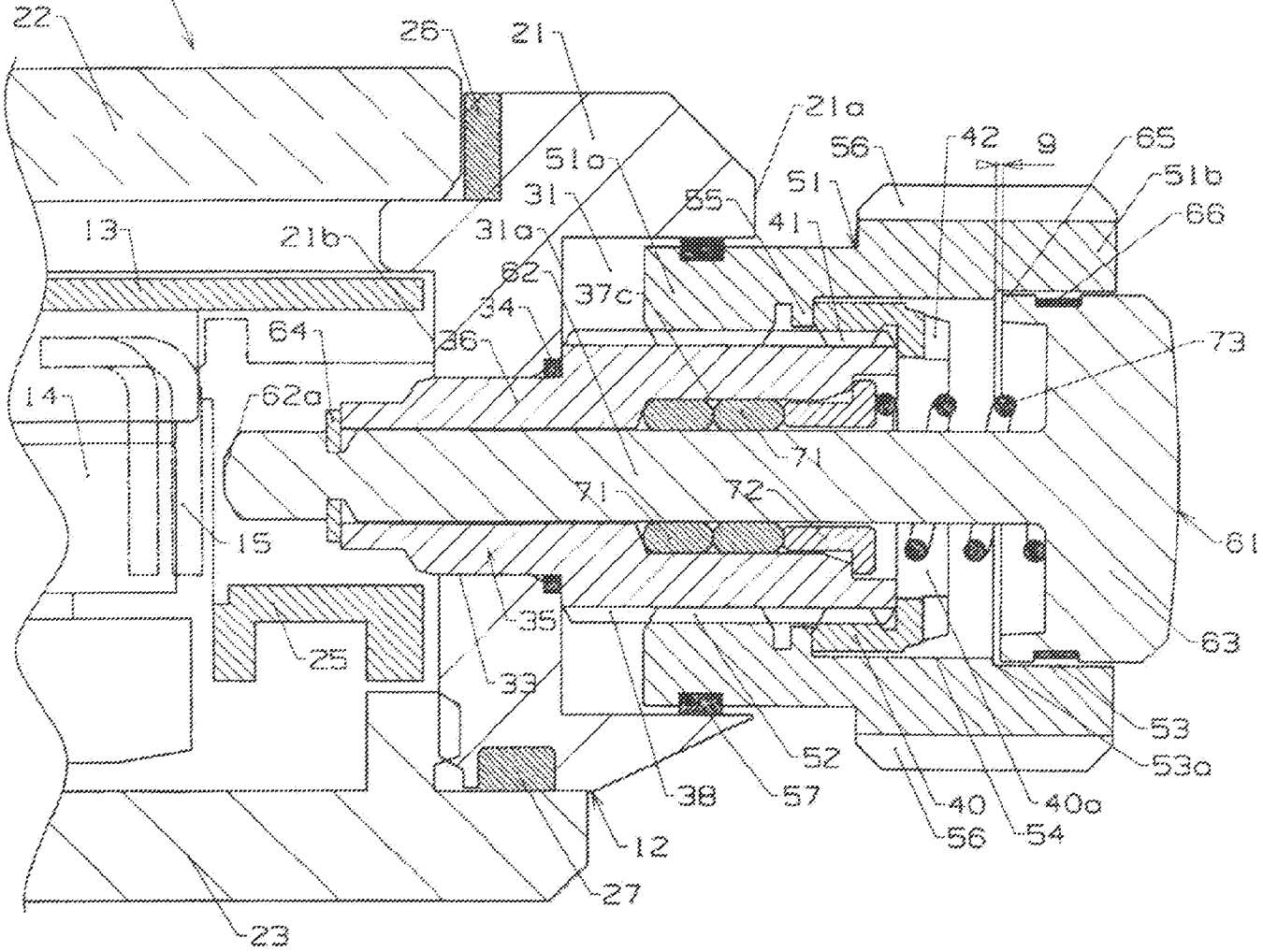
FIG. 5 is a cross-sectional view corresponding to FIG. 4 showing a wrist watch according to a second embodiment of the present invention.

FIG. 5 shows the second embodiment of the present invention. The constitution of the second embodiment is equal to the constitution of the first embodiment except for the constitution explained hereinafter. Accordingly, in the second embodiment, the constitutions identical with the constitutions of the first embodiment or the constitutions having the same functions as the constitutions of the first embodiment are given the same symbols as the first embodiment, and the explanation of these constitutions is omitted.

In the second embodiment, an outer peripheral diameter of an externally arranged sleeve portion 37 of a pipe 35 is equal over respective portions of the externally arranged sleeve portion 37, and a male threaded portion 38 is formed on the externally arranged sleeve portion 37 over a substantially whole length of the externally arranged sleeve portion 37. That is, the small-diameter portion and the male threaded portion formed on the small-diameter portion explained in conjunction with the first embodiment are omitted in the second embodiment.

In the second embodiment, a stopper portion 40 is threadedly engaged with the male threaded portion 38 formed on a distal end portion of the externally arranged sleeve portion 37. Along with such a constitution, in the second embodiment, a locking member 51 is threadedly engaged with the male threaded portion 38 between a bottom surface 31*a* of a recessed portion 31 and the locking member 51.

Further, in the second embodiment, a small-diameter portion 51*a* and a large-diameter portion 51*b* of the locking member 51 respectively have larger diameters than those of the corresponding portions of the first embodiment, and a recessed portion 31 also has a large diameter corresponding to an outer diameter of the small-diameter portion 51*a*. The second embodiment is equal to the first embodiment except for the above-explained constitutions.

Accordingly, the second embodiment can also solve the task to be solved by the present invention because of the reasons explained in conjunction with the first embodiment. In addition, the second embodiment is superior to the first embodiment with respect to following points.

Firstly, a shape of an outer peripheral surface of the externally arranged sleeve portion 37 of the pipe 35 becomes simple and hence, in addition to an advantage that working applied to the pipe 35 can be performed easily, it is sufficient to perform working for forming the threaded portion on the outer periphery of the externally arranged sleeve portion 37 of the pipe 35 only one time. Accordingly, a working cost of the pipe 35 can be reduced.

Secondarily, the stopper portion 40 is threadedly engaged with the male threaded portion 38 and hence, an outer diameter of the stopper portion 40 is larger than an outer diameter of the male threaded portion 38, that is, a largest outer diameter of the pipe 35. Accordingly, an intermediate recessed portion 54 formed on the locking member 51 which covers the stopper portion 40 has a large inner diameter, and the locking member 51 also has a large outer diameter corresponding to the large inner diameter of the intermediate recessed portion 54.

Accordingly, the above-mentioned constitution is preferably applicable to a wrist watch having a large thickness which includes the push button 61 and in which an outer diameter of the locking member 51 is required to be large. In addition, by adopting the locking member 51 having a large diameter, a torque for rotatably operating the locking member 51 is increased and hence, the operability of the locking member 51 is enhanced. Nevertheless, there is no possibility that an excessively large force by which the retainer ring 64 is pulled into the inside of the pipe 35 as described above is applied to the push button 61.

Figure 6:
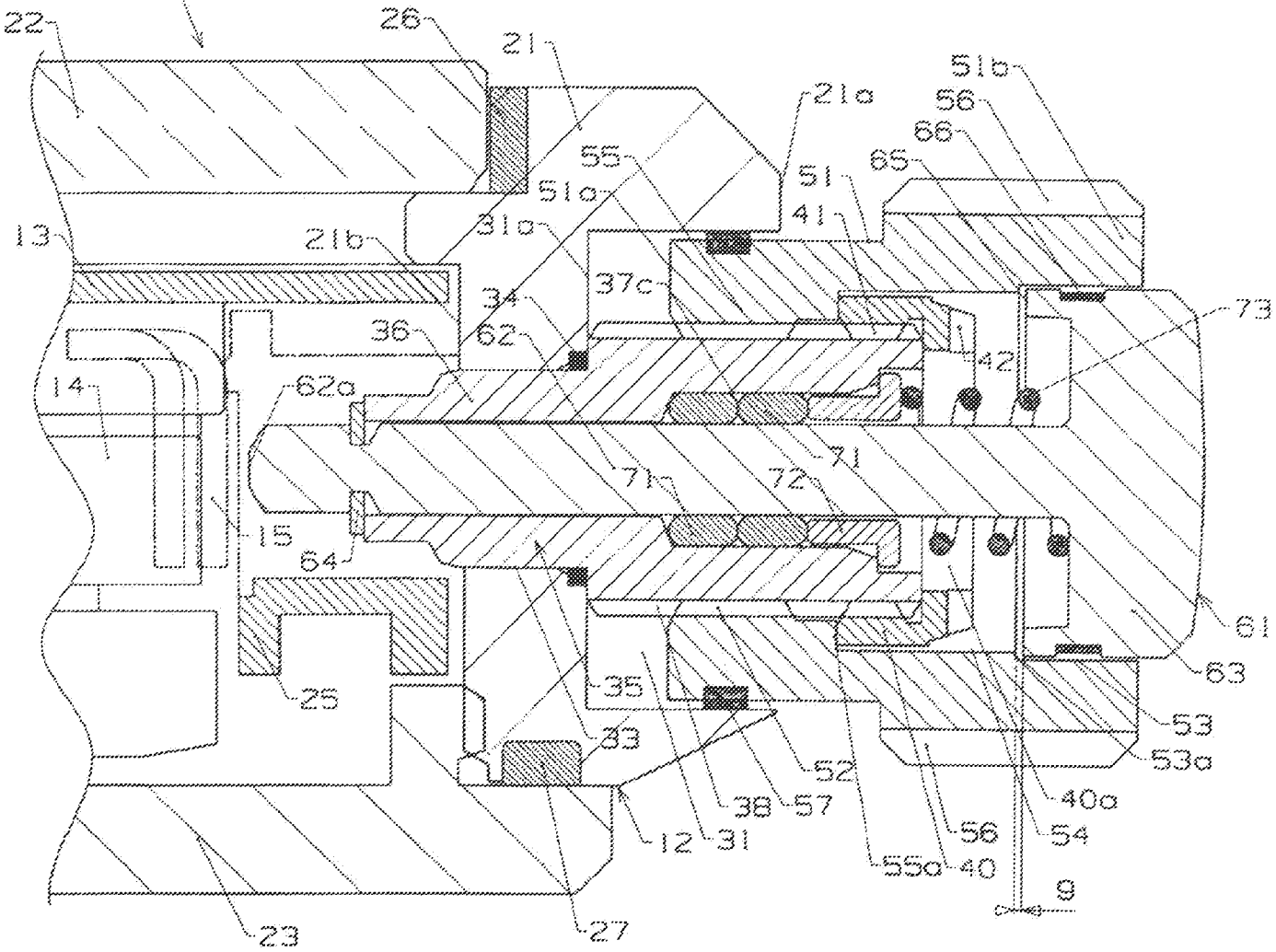
FIG. 6 is a cross-sectional view corresponding to FIG. 4 showing a wrist watch according to a third embodiment of the present invention.

FIG. 6 shows the third embodiment of the present invention. The constitution of the third embodiment is equal to the constitution of the second embodiment except for the constitution explained hereinafter and hence, in the third embodiment, the constitutions identical with the constitutions of the second embodiment and the constitutions having the same functions as the constitutions of the second embodiment are given the same symbols as the second embodiment and the explanation of these constitutions is omitted.

In the third embodiment, a locking portion 55 of a locking member 51 is formed such that the locking portion 55 partitions a bottom of an intermediate recessed portion 54 and occupies an area ranging from the partitioned portion of the bottom of the intermediate recessed portion 54 to a distal end surface of a small-diameter portion 51*a*. An inner diameter of the locking portion 55 is smaller than an inner diameter of the intermediate recessed portion 54. A side surface 55*a* of the locking portion 55 also functions as a bottom surface of the intermediate recessed portion 54.

The side surface 55*a* is used as an engaging surface which is brought into contact with and is separated from the stopper portion 40. Further, a female threaded portion 52 is formed on the inner periphery of the locking portion 55. The locking member 51 is mounted on the pipe 35 by threadedly engaging the female threaded portion 52 thereof with a male threaded portion 38 formed on a pipe 35. The third embodiment is equal to the second embodiment except for the above-explained constitution.

Accordingly, the third embodiment can also solve the task to be solved by the present invention because of the same reasons explained in conjunction with the second embodiment. In addition, in the third embodiment, a step of working for forming the female threaded portion 52 and the locking portion 55 separately parallel to each other in the axial direction of the locking member 51 can be omitted and hence, the third embodiment is superior to the second embodiment with respect to a point that a working cost of the locking member 51 can be further reduced.

Figure 7:
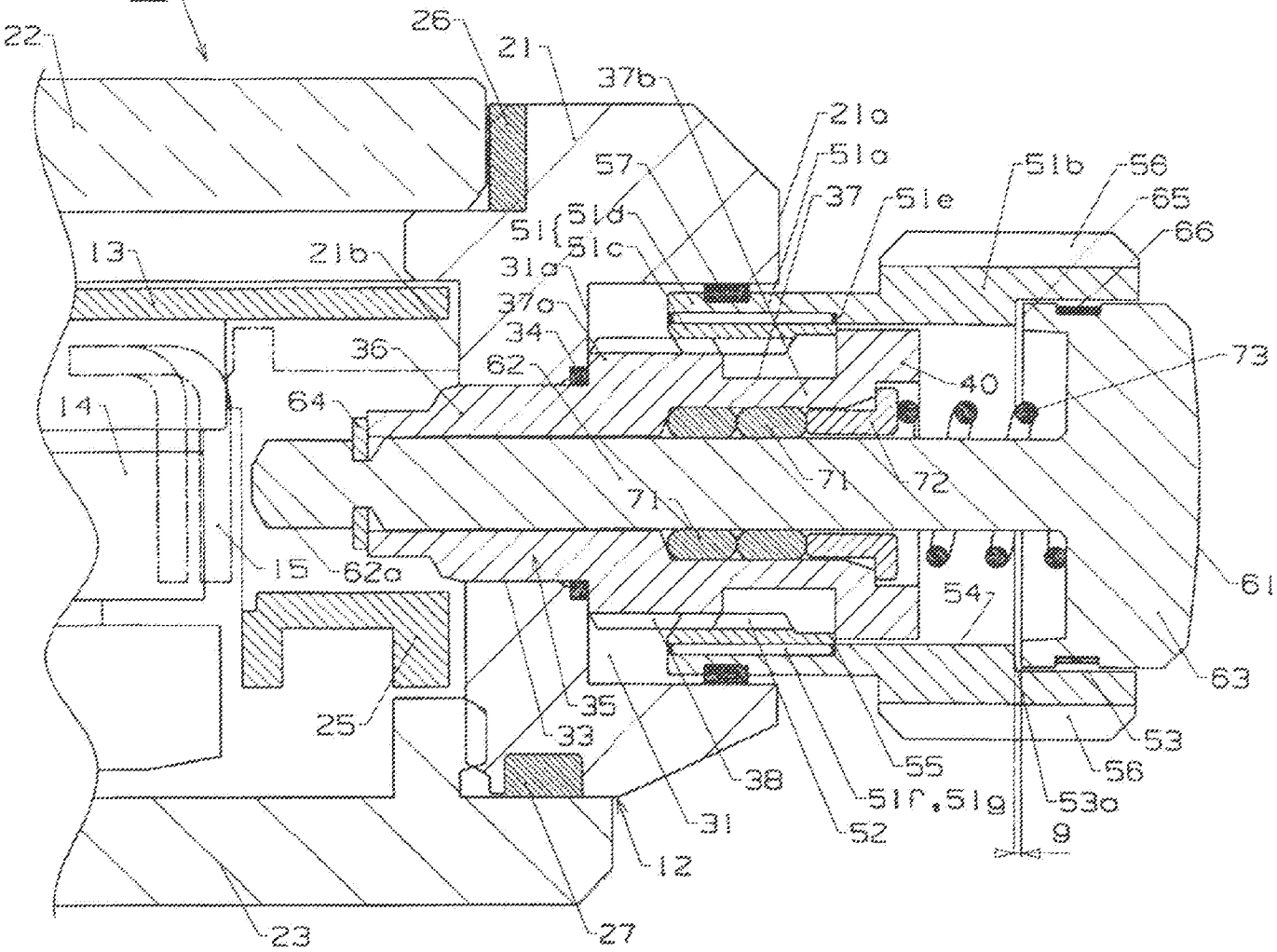
FIG. 7 is a cross-sectional view corresponding to FIG. 4 showing a wrist watch according to a fourth embodiment of the present invention.

FIG. 7 shows the fourth embodiment of the present invention. The constitution of the fourth embodiment is equal to the constitution of the first embodiment except for the constitution explained hereinafter and hence, in the fourth embodiment, the constitutions identical with the constitutions of the first embodiment and the constitutions having the same functions as the constitutions of the first embodiment are given the same symbols as the first embodiment and the explanation of these constitutions is omitted.

In the fourth embodiment, a stopper portion 40 is integrally formed on the outer periphery of a small-diameter portion 37*b* of an externally arranged sleeve portion 37 of a pipe 35. An outer diameter of the stopper portion 40 is set larger than an outer diameter of a male threaded portion 38.

Further, in the fourth embodiment, the locking member 51 is formed of two members, that is, a first member element 51*c* and a second member element 51*d*.

That is, the first member element 51*c* has a ring shape. A female threaded portion 52 which is threadedly engaged with a male threaded portion 38 of a pipe 35 is formed on the inner periphery of the first member element 51*c*, and a locking portion 55 is formed on the first member element 51*c* at a position displaced from the female threaded portion 52. An inner diameter of the locking portion 55 is slightly larger than an outer diameter of the male threaded portion 38 formed on the pipe 35. A male threaded portion 51*f* is formed on the outer periphery of the first member element 51*c*.

The first member element 51*c* is, before the pipe 35 is mounted on a barrel 21 by brazing, mounted on the male threaded portion 38 of the pipe 35 by threaded engagement from an insertion sleeve portion 36 side, and is held in a positioning state where the locking portion 55 is brought into contact with the stopper portion 40.

The second member element 51*d* includes a small-diameter portion 51*a* which forms a female threaded portion 51*g* on the inner periphery thereof, and a large-diameter portion 51*b* which has cut grooves 56 on the outer periphery thereof. An inner diameter of an intermediate recessed portion 54 which forms the smallest inner diameter of the second member element 51*d* is set larger than an outer diameter of the stopper portion 40. A stepped portion 51*e* which is brought into contact with a proximal portion of the locking portion 55 is formed on an inner surface of the second member element 51*d*.

The second member element 51*d* is connected to the first member element 51*c* in such a manner that the second member element 51*d* is threadedly engaged with the outer periphery of the first member element 51*c* which is arranged in a state where the first member element 51*c* is positioned by the stopper portion 40 from a side opposite to an insertion sleeve portion 36. Here, a rotational direction of the second member element 51*d* is equal to the rotational direction of the first member element 51*c* when the first member element 51*c* is threadedly engaged from an insertion sleeve portion 36 side until the first member element 51*c* is brought into contact with the stopper portion 40. Accordingly, the male threaded portion 51*f* of the first member element 51*c* and the female threaded portion 51*g* of the second member element 51*d* can be threadedly engaged with each other. Due to such threaded engagement, the locking member 51 is assembled in a state where the proximal portion of the locking portion 55 is brought into contact with the stepped portion 51*e*.

In this case, the first member element 51*c* and the second member element 51*d* are connected to each other by applying an adhesive agent to the inner periphery of the small-diameter portion 51*a*, that is, to the female threaded portion 51*f* formed on the small-diameter portion 51*a*. Accordingly, when the locking member 51 is moved between an unlocked position and a locked position, there is no possibility that the connection between the first member element 51*c* and the second member element 51*d* is inadvertently released. By setting an adhesive force for adhering the first member element 51*c* and the second member element 51*d* to each other to an extent that the threaded engagement between the female threaded portion 51*g* and the male threaded portion 51*f* can be released when necessary, parts around the push button 61 can be disassembled and cleaned.

As described above, although the pipe 35 includes the stopper portion 40 which is integrally formed with the externally arranged sleeve portion 37 of the pipe 35, the locking member 51 having the locking portion 55 which is brought into contact with and is separated from the stopper portion 40 can be arranged between the male threaded portion 38 of the externally arranged sleeve portion 37 and the stopper portion 40 in a state where the locking member 51 covers the externally arranged sleeve portion 37. The fourth embodiment is equal to the first embodiment with respect to the constitutions except for the constitutions explained heretofore and the assembling steps of the parts around the pipe 35 except for the assembling steps explained heretofore.

Accordingly, the fourth embodiment also can solve the task to be solved by the present invention because of the reasons explained in conjunction with the first embodiment. In addition, in the fourth embodiment, the stopper portion 40 is integrally formed with the externally arranged sleeve portion 37. Accordingly, the locking member 51 can be accurately positioned at a locked position by the stopper portion 40 with high reliability. Further, along with such positioning of the locking member 51 with high reliability, man-hours for forming threads on the externally arranged sleeve portion 37 can be decreased and hence, the fourth embodiment is superior to the first embodiment with respect to a point that a working cost of the locking member 51 can be decreased and the like.

The invention claimed is:

1. A portable apparatus comprising:

an apparatus exterior body in which a through hole is formed;

a pipe which includes an insertion sleeve portion which is inserted into the through hole and is fixed to the apparatus exterior body, and an externally arranged sleeve portion which is arranged outside the apparatus exterior body integrally with the insertion sleeve portion and on which a male threaded portion is formed;

a stopper ring threadedly engaged with a distal end portion of the externally arranged sleeve portion so that a bottom wall of the stopper ring contacts the distal end of the externally arranged sleeve portion;

a locking member which includes a locking portion arranged to be brought into and out of contact with the stopper ring, a recessed portion for accommodating button pushing, and a female threaded portion threadedly engaged with the male threaded portion, the locking member being mounted to undergo movement in the axial direction of the pipe while covering the externally arranged sleeve portion;

a push button which includes a shaft portion which passes through the pipe, and a head which has an opposedly facing portion which opposedly faces a bottom surface of the recessed portion and is positioned outside the apparatus exterior body, the push button being mounted to undergo movement in the axial direction, a spring which biases the push button toward the outside of the apparatus exterior body, and a retainer ring which is mounted on a shaft end portion of the shaft portion which is positioned in the inside of the apparatus exterior body for preventing the removal of the push button from the pipe, wherein a spaced-apart distance A, in the axial direction, between the stopper ring and the locking portion which opposedly faces the stopper ring in a state where the locking member is brought into contact with the apparatus exterior body and a spaced-apart distance B, in the axial direction, between the bottom surface of the recessed portion and the opposedly facing portion of the head in the same state are set to satisfy the relationship of $A \leq B$.

2. The portable apparatus according to claim 1, wherein the spaced-apart distance B is larger than the spaced-apart distance A.

3. The portable apparatus according to claim 1, wherein the stopper ring allows the shaft portion and the spring to pass therethrough, and is removably threadedly engaged with the externally arranged sleeve portion.

4. The portable apparatus according to claim 3, wherein the externally arranged sleeve portion includes a large-diameter portion and a small-diameter portion which is continuously formed with the large-diameter portion, the male threaded portion is formed on the large-diameter portion, another male threaded portion having a diameter smaller than the male threaded portion is formed on the small-diameter portion, and the stopper ring is threadedly engaged with said another male threaded portion.

5. The portable apparatus according to claim 3, wherein an outer peripheral diameter of the externally arranged sleeve portion is equal over respective portions of the externally arranged sleeve portion, the male threaded portion is formed over a substantially total length of the externally arranged sleeve portion, and the locking member and the stopper ring are threadedly engaged with the male threaded portion respectively.

6. The portable apparatus according to claim 5, wherein the female threaded portion is formed on the inner periphery of the locking portion.

7. The portable apparatus according to claim 1, wherein an indicator mark is provided on the head, the mark being exposed from a distal end of the locking member in a state where the locking member is positioned by being brought into contact with the apparatus exterior body and the mark being covered with a distal end portion of the locking member in a state where the locking portion is brought into contact with the stopper portion.

8. A portable timepiece which is formed of the portable apparatus according to claim 1.

9. A portable apparatus comprising:

an apparatus exterior body having a through hole;

a tubular member having an insertion sleeve portion inserted into the through hole and fixed to the apparatus exterior body, and an external sleeve portion integral with the insertion sleeve portion and disposed outside the apparatus exterior body;

a stopper ring threaded onto a distal end portion of the external sleeve portion until a bottom wall of the stopper ring engages with the distal end of the external sleeve portion;

a depressible pushbutton having a shaft portion slidably extending through the tubular member, and a head integral with the shaft portion and disposed outside the apparatus exterior body;

a spring that biases the pushbutton outward toward the outside of the apparatus exterior body;

a retainer mounted on an end portion of the pushbutton shaft portion that extends inside of the apparatus exterior body for preventing outward removal of the pushbutton from the tubular member; and a rotatable ring-shaped locking member surrounding the external sleeve portion of the tubular member and threadedly engaged with the tubular member to undergo outward and inward movement in the axial direction of the tubular member to locked and unlocked positions in response to rotation of the locking member in opposite directions, the locking member having a recessed portion having a bottom surface which opposedly faces an opposedly facing portion of the pushbutton head and being configured to receive therein the pushbutton head, and a locking portion that abuts the stopper ring when the locking member is in the locked position, wherein when the locking member is in the unlocked position, the locking portion is axially spaced a distance A from the stopper, and the bottom surface of the recessed portion is axially spaced a distance B from the opposedly facing portion of the pushbutton head, wherein $A \leq B$.

10. A portable apparatus according to claim 9; wherein the distance A is smaller than the distance B.

11. A portable apparatus according to claim 9; wherein the external sleeve portion has a threaded portion threadedly engaged with the locking member and with the stopper ring.

12. A portable apparatus according to claim 11; wherein the threaded portion of the external sleeve portion is a male threaded portion, and the locking member and the stopper ring have female threaded portions threadedly engaged with the male threaded portion.

13. A portable apparatus according to claim 12; wherein the female threaded portion of the locking member is formed on the inner periphery of the locking portion.

14. A portable apparatus according to claim 13; wherein the distance A is smaller than the distance B.

15. A portable apparatus according to claim 9; wherein the head has an indicator mark on the outer periphery thereof, the indicator mark being exposed and visible when the locking member is in the unlocked position and being covered and concealed by the locking member when the locking member is in the locked position.

16. A portable apparatus according to claim 9; wherein the portable apparatus comprises a portable timepiece.

* * * * *